US005913982A

United States Patent [19]

Phillips

[11] Patent Number: 5,913,982

[45] Date of Patent: Jun. 22, 1999

[54] WATER DRIVEN BATHROOM SCRUB BRUSH SYSTEM

[76] Inventor: Patrick Stephen Phillips, 968 ADM, Callaghan #148, Vallejo, Calif. 94591

[21] Appl. No.: 08/971,377

[22] Filed: Nov. 17, 1997

Related U.S. Application Data

[60] Provisional application No. 60/056,184, Aug. 19, 1997.

[51] Int. Cl.[6] ..... B08B 7/00

[52] U.S. Cl. ..... 134/6; 15/24; 15/29

[58] Field of Search ..... 134/6; 15/24, 29

[56] References Cited

U.S. PATENT DOCUMENTS 4,513,466 4/1985 Keddie et al. ..... 15/29

*Primary Examiner*—Zeinab El-Arini

*Attorney, Agent, or Firm*—Goldstein & Canino

[57] ABSTRACT

The invention includes a water driven brush mechanism which is pivotally attached to a rigid hose. The rigid hose acts as a handle to the user and a conduit to supply water to the brush mechanism. The pivotal attachment allows the user to change the angle of the brush mechanism to the rigid pipe to facilitate the cleaning process. The rigid hose is attached to a flexible hose on the opposite end of the brush mechanism. The flexible hose in turn attaches to the faucet or shower head for the necessary water supply. The flexible hose is necessary to provide easy movement of the brush mechanism to a variety of positions with respect to the faucet or shower head. The flexible hose is also of sufficient length as to easily reach the desired surface to be cleaned. The flexible hose has a male threaded end cap which can engage with the threaded male end of a shower head by use of a coupling device. Alternatively, the flexible hose can be attached to the threaded end of a grommet device which snugly fits over a bathtub faucet.

11 Claims, 7 Drawing Sheets

12
10
13
14
11

WATER DRIVEN BATHROOM SCRUB BRUSH SYSTEM

CROSS REFERENCES AND RELATED SUBJECT MATTER

This application refers to subject matter filed in the U.S. Patent Office on Aug. 19, 1997 in provisional patent application Ser. No. 60/056,184.

BACKGROUND OF THE INVENTION

The invention relates to a bathroom scrub brush. More specifically the invention relates to bathroom scrub brush which can easily attach to a bathtub faucet or shower pipe and be used to wash bathroom surfaces.

Clean bathroom surfaces are essential for many reasons. The moist wet surfaces in bathrooms provide a haven for bacteria and viruses and must be kept under control to prevent disease. If the bathroom is not kept impeccably clean, a bathroom user can be exposed to such ailments as foot fungus, the common cold, or other more serious illnesses. A clean bath area is also a matter of personal pride. It can be very embarrassing to have a guest use bathroom facilities which are unsanitary or even unsightly.

The reality is that many bathrooms are not kept as clean as the user might desire due to the hassle involved in cleaning bathroom surfaces such as the bathtub and shower stall.

The conventional method of cleaning a bathroom consists of filling a bucket with detergent and water and manually scrubbing the surfaces with a sponge or brush. This method has many inherent problems. Such a method involves repeatedly rinsing the brush and having to fill and dump the bucket numerous times to discard dirty water. The soap or detergent can also cause skin irritations or allergic reactions.

Wearing rubber gloves can combat the skin irritation problem but rubber gloves are known to be very uncomfortable because they promote excess sweating of the hands. Also, a percentage of the general public cannot use rubber gloves due to latex allergy which can cause severe itching, rash and possible anaphylactic shock.

Another problem with manual cleaning is that the person cleaning must manipulate their body in many ways to reach all of the surfaces. This includes kneeling on hard surfaces which can cause knee and back problems. Reaching higher surfaces involves reaching over ones head. This latter movement can easily cause a person to lose their footing on slick surfaces and cause serious injury.

U.S. Pat. No. 4,513,466 to Keddie et al. describes a water driven brush which is hand held and intended for use on such surfaces as automobiles.

While these units may be suitable for the particular purpose employed, or for general use, they would not be as suitable for the purposes of the present invention as disclosed hereafter.

SUMMARY OF THE INVENTION

It is an object of the invention to produce a water driven bathroom scrub brush which can be used to clean a bathtub or shower stall.

It is another object of the invention to produce a water driven bathroom scrub brush which can easily attach to a faucet or shower head to provide the necessary water source.

It is still another object of the invention to produce a water driven bathroom scrub brush which keeps the user out of contact with the detergent and water.

It is a further object of the invention to produce a water driven bathroom scrub brush which can be extended and turned in a variety of positions to allow the user to clean a bathroom surface without kneeling or reaching.

The invention comprises a water driven brush mechanism which is pivotally attached to a rigid hose. The rigid hose acts as a handle to the user and a conduit to supply water to the brush mechanism. The pivotal attachment allows the user to change the angle of the brush mechanism to the rigid pipe to facilitate the cleaning process. The rigid hose is attached to a flexible hose on the opposite end of the brush mechanism. The flexible hose in turn attaches to the faucet or shower head for the necessary water supply. The flexible hose is necessary to provide easy movement of the brush mechanism to a variety of positions with respect to the faucet or shower head. The flexible hose is also of sufficient length as to easily reach the desired surface to be cleaned. The flexible hose has a male threaded end cap which can engage with the threaded male end of a shower head by use of a coupling device. Alternatively, the flexible hose can be attached to the threaded end of a grommet device which snugly fits over a bathtub faucet.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
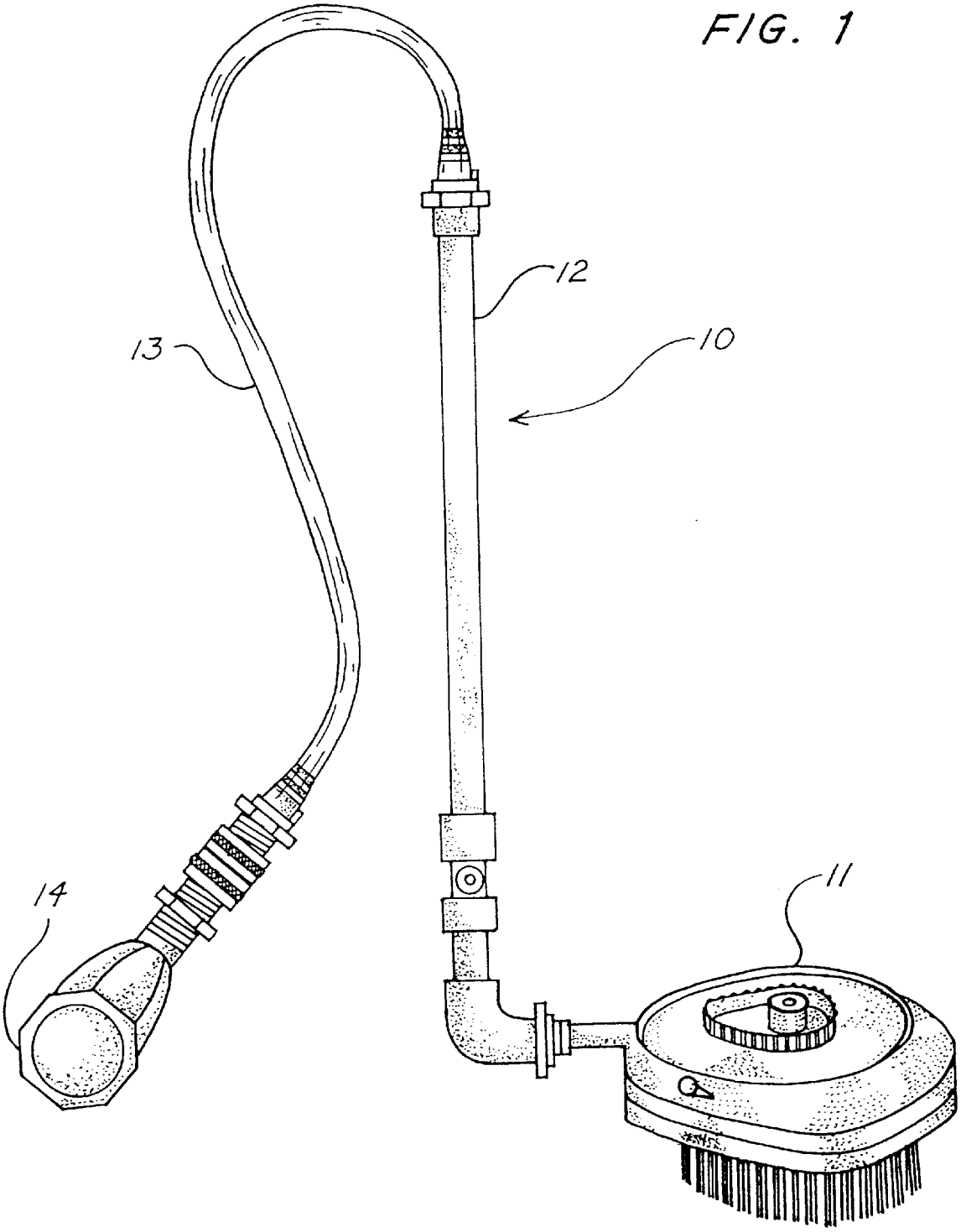
FIG. 1 is a perspective view of the assembled invention in position, ready to attach to a bathtub faucet.

FIG. 1 illustrates a water driven bathroom scrub brush 10 which can attach to a bathroom fixture such as a shower pipe or a bathtub faucet. The water driven bathroom scrub brush 10 has a water driven brush mechanism 11, and a rigid pipe 12, attached to the water driven brush mechanism. A grommet device 14 is attached to the rigid pipe 12 with a flexible hose 13.

Figure 2:
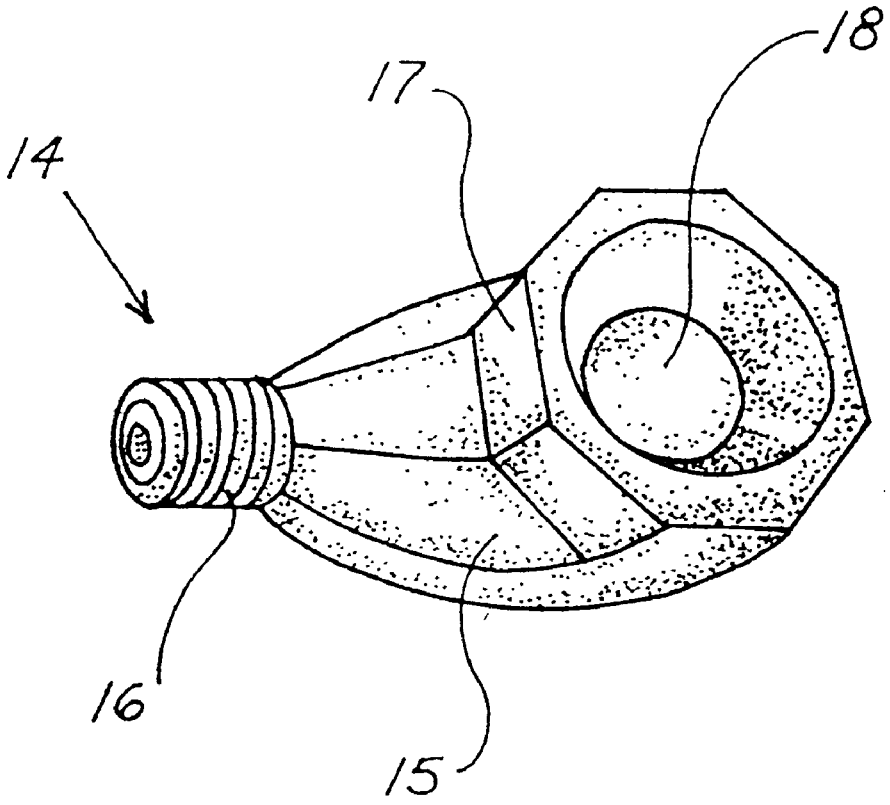
FIG. 2 is a perspective view detailing a grommet device for use in attaching the invention to a bathtub faucet.

The grommet device 14 as illustrated in FIG. 2, comprises a curved housing 15 having a tapered threaded end 16 and a cylindrical end 17 which is perpendicular to the tapered end 16. An internal bore 18 extends through the housing 15 from the cylindrical end 17 to the tapered end 16. The internal bore 18 follows the shape of the housing 15 by tapering toward the tapered end 16 of the housing 15.

Figure 3:
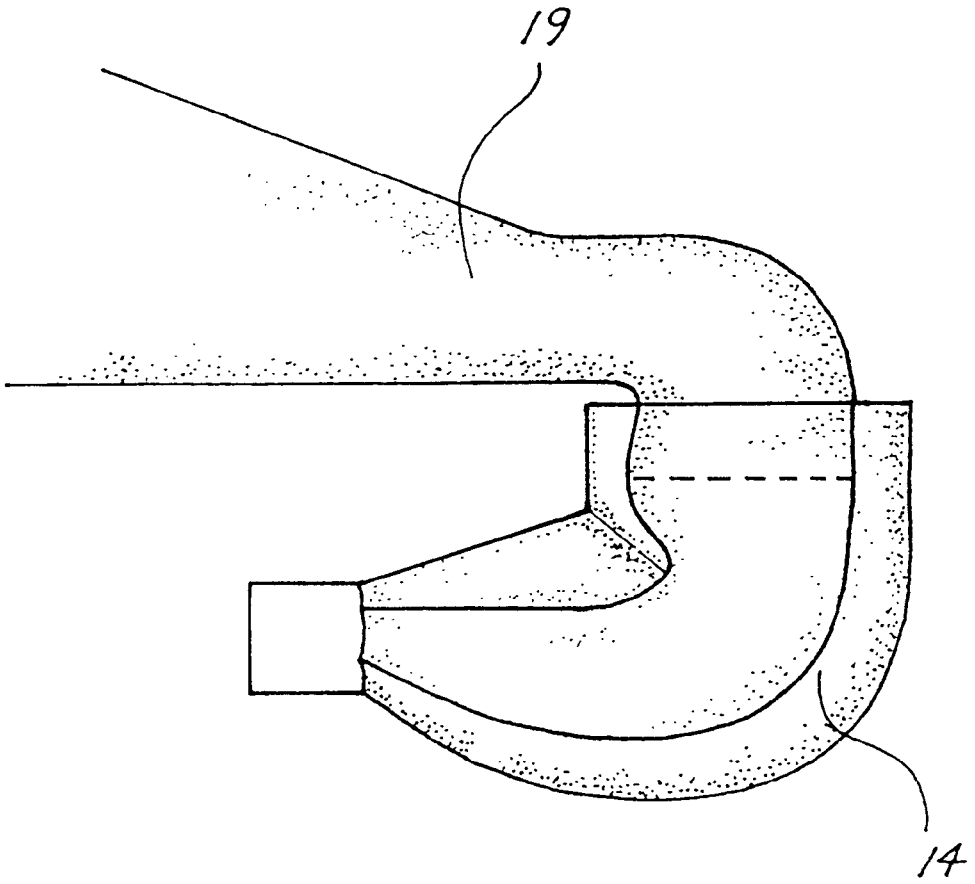
FIG. 3 is a side elevational view of the grommet device partially engaging the bathtub faucet.

The internal bore 18 is sized to accommodate a standard bathtub faucet 19 at the connecting end 17, as illustrated in FIG. 3, whereby the faucet 19 is housed within the grommet device 14. FIG. 3 shows the grommet device 14 in initial contact with the bathtub faucet 19.

Figure 4:
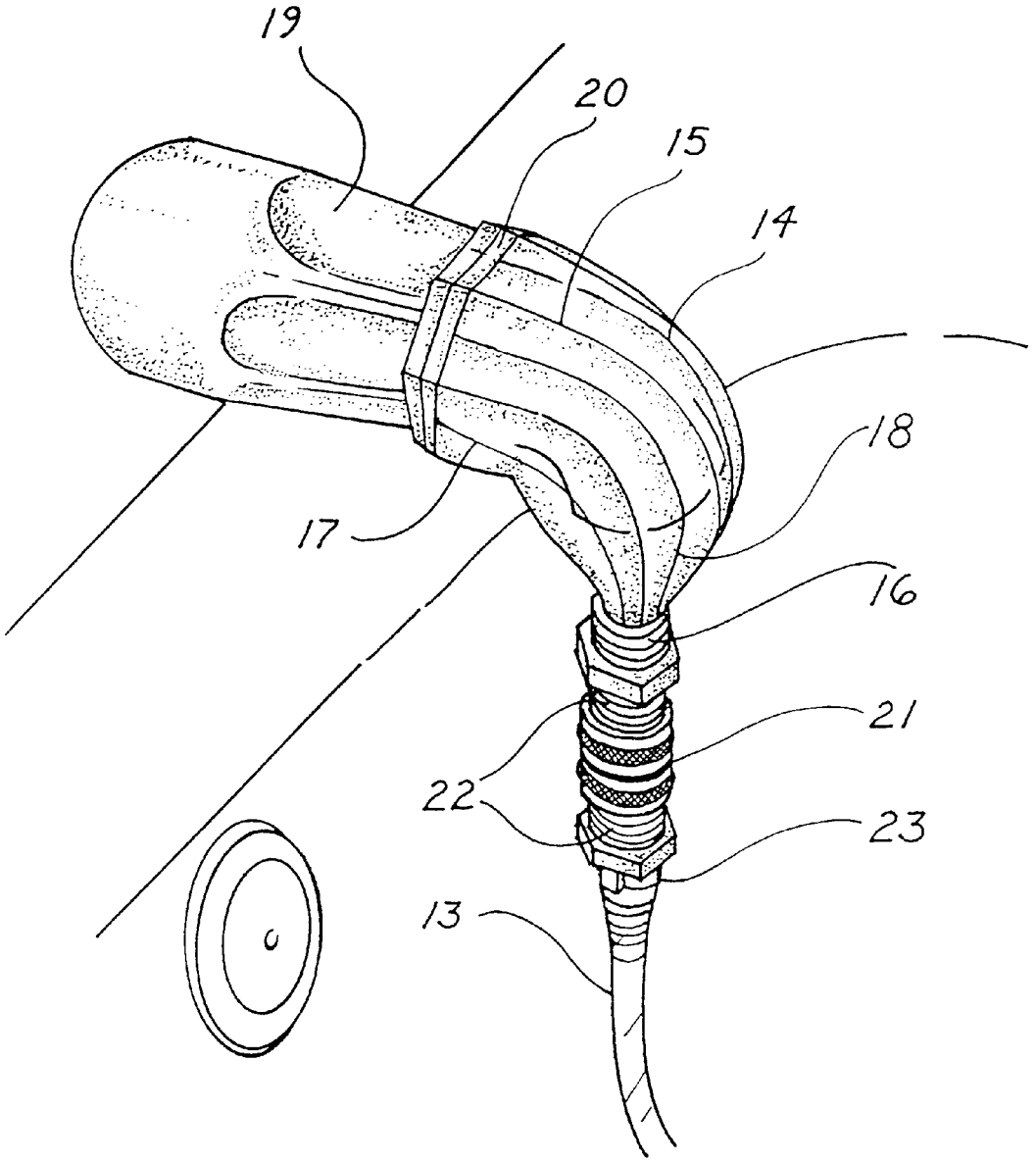
FIG. 4 is a diagrammatic perspective view of the grommet device mounted to the bathtub faucet and ready to use.

FIG. 4 shows the bathtub faucet 19 completely in position within the internal bore 18 of the curved housing 15. When in place, the tapered end 16 is facing downward so as to allow normal water use without the removal of the invention. A clasp 20 may be provided to provide a crimping fit around the cylindrical potion 17 of the grommet device 14. The clasp 20 provides a better fit to a variety of different sizes of bathtub faucets. The clasp 20 also ensures that the grommet device 14 stays in place during operation of the invention, when pressurized water enters the grommet 14. The grommet device 14 is preferably made of a flexible, soft material such as rubber. This construction allows easy application of the grommet device 14 over the faucet 19 and provides a soft finish which will not scratch or mar bathroom surfaces. The tapered end 16 of the grommet device 14 must be made from a hard surface, preferably PVC, in order to allow a threaded fit to a coupling device 21. The coupling device 21 has two female threaded ends 22 to attach the grommet device 14 to an end cap 23 of the flexible hose 13.

Figure 5:
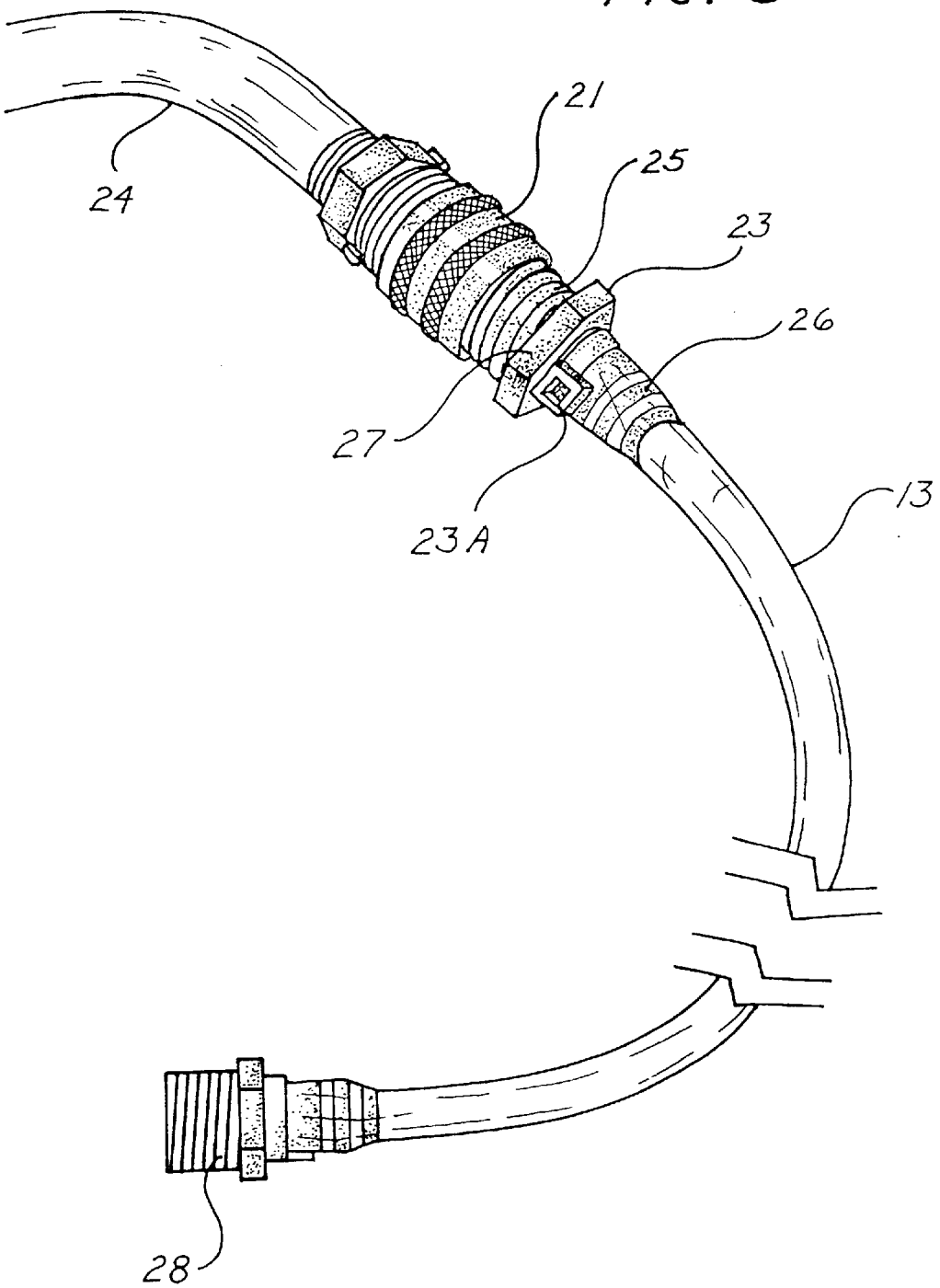
FIG. 5 is a diagrammatic perspective view of the invention attached to a standard shower pipe.

FIG. 5 shows one embodiment of the invention wherein the coupling device 21 has been attached to a standard shower pipe 24 after its shower head has been removed. This manner of mounting the invention does not require the grommet device 14. This allows the invention to be used in standard bathtubs with or without shower heads as well as shower stalls which do not have the typical bathtub faucet.

Again referring to FIG. 5, the end cap 23 has a threaded male end 25 and a ridged end 26, separated by a hexagonal ring 27 to tighten the threaded end 25 into the coupling device 21 using a standard wrench. The ridged end 26 is fitted to frictionally attach the flexible hose 13. The flexible hose 13 allows the user to manipulate the invention in a variety of different angles to clean the various surfaces of the bathtub or shower. The flexible hose 13 must also be of sufficient length as to allow the brush mechanism 11 to reach all of the surfaces to be cleaned. On the opposite end 29 of the flexible hose 13 is a second end cap 28 fitted to the flexible hose 13, opposite the first end cap 23. The flexible hose is attached to the second end cap 28 in the same manner as the first end cap 23 to provide a threaded male end to the flexible hose 13. End cap clamps 23A may be provided on both end caps to ensure the connection between the end caps and the flexible hose 13.

The flexible hose 13 is attached to the rigid pipe 12 by attaching the second end cap 28 thereto. The rigid pipe 12 preferably has internal threads to attach directly to the threaded end cap 28 of the flexible hose 13.

Figure 6:
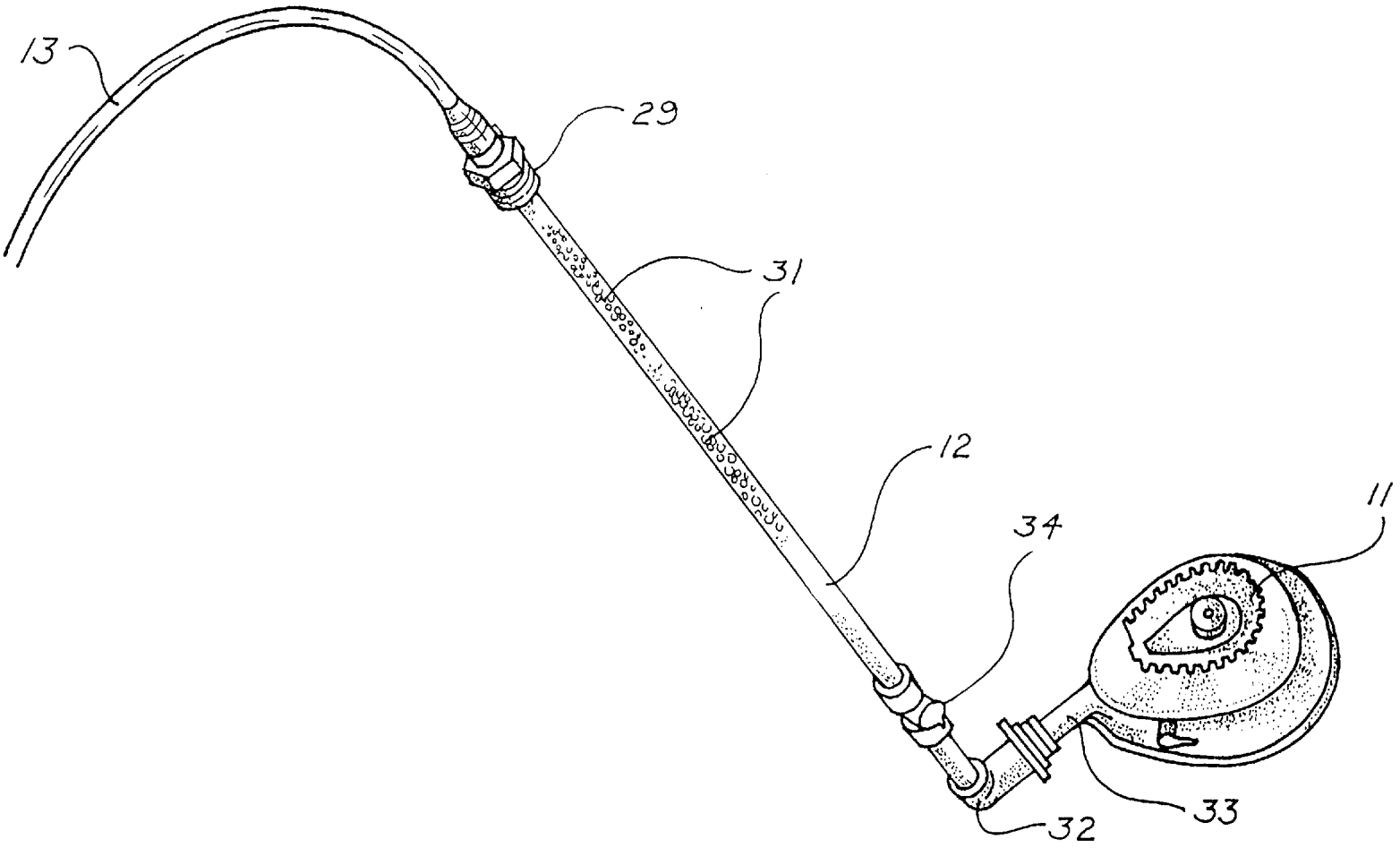
FIG. 6 is a diagrammatic perspective view providing further detail of the rigid pipe section.

Alternatively, the rigid pipe 12 can have male threads 29 and fit to the flexible pipe 13 using a second coupling device 30 as seen in FIG. 6. The rigid pipe 12 allows the brush mechanism 11 to be extended to a cleaning surface away from the user and allows pressure to be exerted without having to hold the brush mechanism 11 directly in hand. The rigid pipe 12 also provides the invention with a firm area in order for the user to grasp and manipulate the invention. Since the invention is made to use in a slick environment the rigid pipe will preferably be fitted with slip free hand grips 31. This can prevent the user from dropping the invention and causing damage to the invention, the bathtub, or the user.

The rigid pipe 12 is connected to the brush mechanism 11 to complete the fluid communication between the water source and the brush mechanism. In one preferred embodiment of the invention as shown in FIG. 6 the rigid handle 12 is attached to an L-shaped fitting 32 which attaches to a shaft 33 of the brush mechanism 11. This attachment has the brush mechanism 11 facing downward and perpendicular with respect to the rigid pipe. This facilitates the use of the invention on wall and floor surfaces. Additionally the brush mechanism 11 can rotate to have an angular relationship with the pipe 12 to easily push the invention along a larger surface. A hand valve 34 is conveniently located at the point between the rigid pipe 12 and the L-shaped fitting 32. This valve 34 temporarily shuts the water supply to the brush mechanism 11 without having to shut off the original water source.

Figure 7:
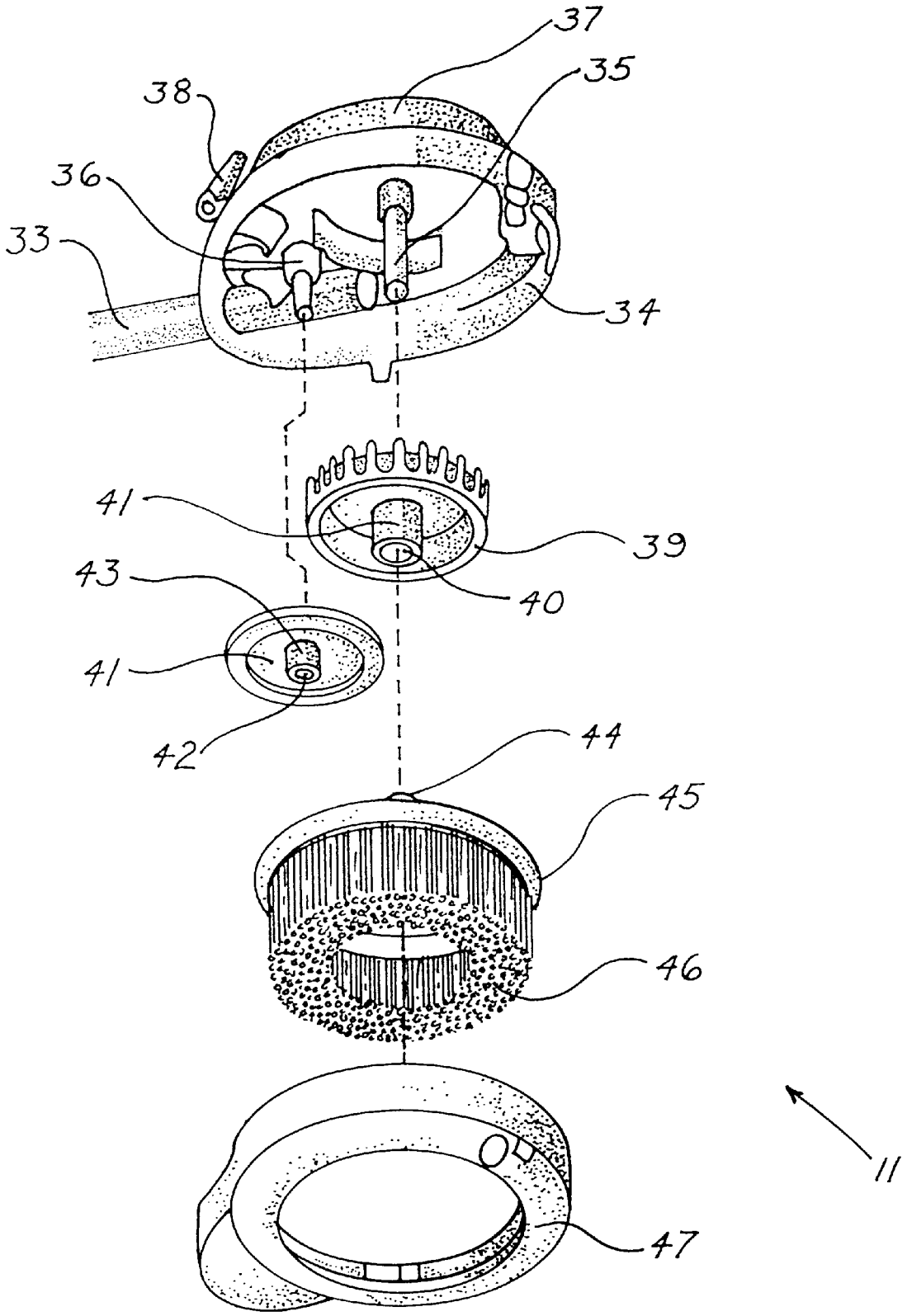
FIG. 7 is an exploded view of the water driven bathroom scrub brush.

The brush mechanism of the invention is a water driven brush mechanism similar to that disclosed in U.S. Pat. No. 4,513,466 to Keddie et al. Referring to FIG. 7 the brush mechanism 11 comprises an upper housing 34 having a shaft 33. The upper housing 34 has first shaft 35 and a second shaft 36 extending perpendicular to the housing 34. The housing 34 has an upper compartment 37 for containing a detergent which is controlled by a valve 38. A turbine rotor 39 with an internal bore 40 and a pinion 41 at such bore 40 fits loosely over the first shaft 35 . A gear 41 with an internal bore 42 and a pinion 43 at such bore 42 fits over the second shaft 36. The gear 41 engages the turbine rotor pinion 41 and the gear pinion 43 meshes with a second gear 44 located on the base 45 of a rotary brush 46. A lower housing snaps 47 into place with the upper housing 34 and encases all of the components.

When the water is fluidally communicated between the water source and the brush mechanism 11, water enters the system through the shaft 33. The turbine rotor 39 rotates from the pressurized water which in turn causes the gear 41 and rotary brush to rotate 46. The rotating brush in combination with the detergent water released by the valve 38 provides the desired result of the invention.

In conclusion, a water driven bathroom scrub brush is presented which can easily attach to a shower pipe or a bathtub faucet. The invention allows the user to easily and efficiently wash bathroom surfaces such as bathtubs and shower stalls.

What is claimed is:

1. A water driven bathroom scrub brush for attachment to a threaded shower pipe comprising:

a water driven brush mechanism;

a rigid hose;

a pivotal attachment mechanism for attaching the rigid hose to the brush mechanism;

a flexible hose attached to the rigid hose;

a threaded end cap attached to the end of the flexible hose;

a coupling device to attach the threaded end cap to the threaded shower pipe.

2. The water driven bathroom scrub brush as recited in claim 1, further comprising a valve mechanism fitted on the rigid hose to temporarily stop water flow to the water driven brush mechanism without shutting the actual water source.

3. A water driven bathroom scrub brush for attachment to a bathtub faucet which provides an actual water source comprising:

a water driven brush mechanism;

a rigid hose;

a pivotal attachment mechanism for attaching the rigid hose to the brush mechanism;

a flexible hose attached to the rigid hose;

a threaded end cap attached to the end of the flexible hose;

an attachment device to fit over the bathtub faucet;

a coupling device to attach the threaded end cap to the attachment device.

4. The water driven bathroom scrub brush as recited in claim 3, wherein the attachment mechanism is a grommet which comprises:

a flexible rubber curved housing having a tapered threaded end and an extension on one side, the housing having an internal bore extending from the extension to the tapered end, the internal bore tapering in diameter from the extension to snugly fit over a bathtub faucet to provide a threaded connection.

5. The water driven bathroom scrub brush as recited in claim 4, further comprising a clamp device to fit over the housing to ensure a proper fit between the housing and a variety of different sized faucets.

6. The water driven bathroom scrub brush as recited in claim 3, further comprising a valve mechanism fitted on the rigid hose to temporarily stop water flow without shutting the actual water source.

7. A bathroom cleaning method using a water driven brush mechanism and a shower pipe capable of supplying water, said method comprising the steps of:

attaching the brush mechanism to the shower pipe, said attaching step further comprising the steps of:

pivotally attaching a rigid pipe to the brush mechanism, attaching a flexible hose to the rigid pipe, placing a threaded end cap on the end of the flexible hose, engaging a coupling device to the end cap, and sawing the coupling device onto a shower pipe wherein water is fluidally communicated from the shower pipe to the brush mechanism;

turning on the shower pipe to initialize water flow to the brush; and cleaning a bathroom surface with the brush which is rotated by the water flow.

8. The bathroom cleaning method of claim 7 wherein the step of attaching the brush to the shower pipe is preceded by attaching a valve mechanism to the rigid hose to temporarily stop the water flow without shutting the actual water source.

9. A bathroom cleaning method using a water driven brush mechanism and a bathtub faucet capable of supplying water, said method comprising the steps of:

attaching the brush mechanism to the bathtub faucet, said attaching step further comprising the steps of:

pivotally attaching a rigid pipe to the brush mechanism, attaching a flexible hose to the rigid pipe, placing a threaded end cap on the end of the flexible hose, engaging a coupling device to the end cap, and screwing the end cap into an attachment device to complete a connection between the water driven brush and a non-threaded bathtub faucet;

turning on the bathtub faucet to initialize water flow to the brush; and cleaning a bathroom surface with the brush which is rotated by the water flow.

10. Thy bathroom cleaning method of claim 9 wherein the attachment device to complete the connection between the water driven scrub brush and a non-threaded bathtub faucet is a grommet comprising a flexible rubber curved housing having a tapered threaded end and an extension on one side, the housing having an internal bore extending from the extension to the tapered end, the internal bore tapering in diameter from the extension to snugly fit over a bathtub faucet to provide a threaded connection.

11. The bathroom cleaning method of claim 8 wherein the step of attaching the brush to the bathtub faucet is preceded by attaching a valve mechanism to the rigid hose to temporarily stop the water flow without shutting the actual water source.

* * * * *